United States Patent [19]

Forester

[11] Patent Number: 4,775,459

[45] **Date of Patent: * Oct. 4, 1988**

[54] METHOD FOR CONTROLLING FOULING DEPOSIT FORMATION IN PETROLEUM HYDROCARBONS OR PETROCHEMICALS

[75] Inventor: David R. Forester, The Woodland, Tex.

[73] Assignee: Betz Laboratories, Inc., Trevose, Pa.

[ * ] Notice: The portion of the term of this patent subsequent to Mar. 25, 2003 has been disclaimed.

[21] Appl. No.: 931,280

[22] Filed: Nov. 14, 1986

[51] Int. Cl.[4] ..... C10G 9/12; C10G 9/16

[52] U.S. Cl. ..... 208/48 AA; 208/48 R; 208/106; 585/950

[58] Field of Search ..... 208/48 AA; 252/32.7 R, 252/32.7 HC, 389.21, 389.24; 585/950

[56] References Cited

U.S. PATENT DOCUMENTS

| | | | |
|---|---|---|---|
| 2,316,080 | 4/1943 | Loane et al. | 252/46.4 |
| 2,316,082 | 4/1943 | Loane et al. | 252/46.4 |
| 2,655,477 | 10/1953 | Bartleson | 252/32.7 HC |
| 2,785,128 | 3/1957 | Popkin | 252/32.7 E |
| 2,851,416 | 9/1958 | Sabol et al. | 252/32.7 HC |
| 2,962,493 | 11/1960 | Sabol et al. | 252/32.7 HC |
| 3,105,810 | 10/1963 | Miller et al. | 208/48 AA |
| 3,123,630 | 3/1964 | Oberender et al. | 260/461 |
| 3,135,729 | 6/1964 | Kluge et al. | 260/139 |
| 3,162,671 | 12/1964 | Petersen et al. | 260/461 |
| 3,201,438 | 8/1965 | Reed | 252/46.6 |
| 3,217,296 | 9/1966 | Gonzalez | 208/48 |
| 3,271,295 | 9/1966 | Gonzalez | 44/68 |
| 3,281,359 | 10/1966 | Oberender et al. | 252/48.6 |
| 3,301,923 | 1/1967 | Skovronek | 252/46.6 |
| 3,329,612 | 7/1967 | Ferm et al. | 252/32.7 HC |
| 3,405,054 | 10/1968 | Arkis | 208/48 AA |
| 3,437,583 | 4/1969 | Gonzalez | 44/77 |
| 3,442,791 | 5/1969 | Gonzalez | 208/48 |
| 3,489,682 | 1/1970 | Lesuer | 252/32.7 E |
| 3,567,623 | 3/1971 | Hagney | 44/73 |
| 4,024,048 | 5/1977 | Shell et al. | 44/72 |
| 4,024,049 | 5/1977 | Shell | 208/48 |
| 4,024,051 | 5/1977 | Shell et al. | 208/48 AA |
| 4,105,540 | 8/1978 | Weinland | 208/48 AA |
| 4,107,030 | 8/1978 | Slovinsky et al. | 208/48 AA |
| 4,289,635 | 9/1981 | Schroeck | 252/32.7 R |
| 4,542,253 | 9/1985 | Kaplan et al. | 208/48 AA |
| 4,578,178 | 3/1986 | Forester | 208/48 AA |

FOREIGN PATENT DOCUMENTS

| | | | |
|---|---|---|---|
| 1205768 | 6/1986 | Canada | 208/48 AA |
| 985180 | 3/1965 | United Kingdom | 208/48 AA |

*Primary Examiner*—H. M. S. Sneed
*Assistant Examiner*—Helane Myers
*Attorney, Agent, or Firm*—Alexander D. Ricci; Bruce E. Peacock

[57] ABSTRACT

Methods for controlling the formation of fouling deposits in petroleum hydrocarbons or petrochemicals during processing at elevated temperatures are disclosed. The methods comprise adding from about 0.5–10,000 ppm of a Group II(a) cation salt of polyalkenylthiophosphonic acid to the desired petrochemical or hydrocarbon.

11 Claims, No Drawings

METHOD FOR CONTROLLING FOULING DEPOSIT FORMATION IN PETROLEUM HYDROCARBONS OR PETROCHEMICALS

FIELD OF THE INVENTION

The present invention pertains to a method for providing antifouling protection for petroleum hydrocarbons or petrochemicals during processing thereof at elevated temperatures.

BACKGROUND

In the refinery and petrochemical processing of hydrocarbons (e.g., gasoline, gas, oils, naphthas, residuums, chlorinated hydrocarbons, etc.), the hydrocarbons are commonly heated to temperatures of 100° to 1500° F. (most commonly 500°–1000° F.). Similarly, such petroleum hydrocarbons are frequently employed as heated mediums on the "hot side" of heating and heat exchange systems. In such instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shutdowns for cleaning. Moreover, these deposits reduce throughput, which, of course, results in a loss of capacity with a drastic effect in the yield of finished product. Accordingly, these deposits have cause considerable concern to the industry.

While the nature of the foregoing deposits defies precise analysis, they appear to contain either/or a combination of carbonaceous phases which are coke-like in nature, polymers or condensates formed from the petroleum hydrocarbons or impurities present therein and salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economics of the petrochemical process.

SUMMARY OF THE INVENTION

In accordance with the invention, I have found that addition of an inorganic salt of a polyalkenylthiophosphonic acid to the desired petroleum hydrocarbon or petrochemical significantly reduces the fouling tendencies of the petrochemical or petroleum hydrocarbon during the high temperature processing thereof. As to the inorganic salts, Group II(a) elements (or compounds comprising such elements), such as Ca, Mg, Sr, or Ba, are reacted with the desired polyalkenylthiophosphonic acid in accordance with the conventional techniques.

PRIOR ART

Processes for preparing alkaline earth metal salts of hydrocarbon thiophosphonic acids and the use of such salts in the formulation of premium motor oils is disclosed in U.S. Pat. No. 3,135,729 (Kluge et al.).

U.S. Pat. No. 3,405,054 discloses the use of phosphorus sulfide-olefinic polymer reaction products to prevent solids deposition in petroleum refinery processing equipment. The disclosure (Example 1) details the use of a polyisobutenylthiophosphonic acid as such a solids deposition inhibitor. Use of such acid, although successful as an antifoulant, may likely contribute to acidic corrosion of processing equipment.

Polyalkenylthiophosphonic acid and the alcohol/polyglycol esters thereof are disclosed in U.S. Pat. No. 3,281,359 (Oberender et al.). In Oberender et al., these compounds are disclosed as being useful "detergent-dispersant additives in lubricating oil, particularly petroleum lubricating "oil" (see column 1, lines 20–21). Studies have demonstrated that many compounds known to be useful as lubricating oil detergent-dispersants do not adequately function as process antifoulants.

Of somewhat lesser interest is thought to be U.S. Pat. No. 3,123,160 (Oberender et al.) which relates to a process for preparing monohydroxyalkyl hydrocarbyl thiophosphonates by reacting hydrocarbyl thiophosphoric acids with alkylene oxides in the absence of a catalyst.

Other patents which may be of interest to the present invention include: U.S. Pat. Nos. 4,024,051 (Shell) or 4,024,048 (Shell) disclosing the use of inorganic phosphorus containing acid compounds and/or salts thereof as antifoulants; U.S. Pat. No. 3,105,810 (Miller) disclosing oil soluble alkaryl sulfur containing compounds as antifoulants; U.S. Pat. No. 4,107,030 (Slovinsky et al.) disclosing sulfanilic acid amine salt compounds as antifoulants; U.S. Pat. No. 3,489,682 (Lesuer) disclosing methods for preparing metal salts of organic phosphorus acids and hydrocarbon substituted succinic acids; and U.S. Pat. No. 2,785,128 (Popkin) disclosing methods for preparing metal salts of acidic-phosphorus-containing organic compounds.

U.S. Pat. Nos. 3,437,583 (Gonzalez); 3,567,623 (Hagney); 3,217,296 (Gonzalez); 3,442,791 (Gonzalez) and 3,271,295 (Gonzalez); 3,201,438 (Reed) and 3,301,923 (Skovronek) may also be mentioned as being of possible interest.

DETAILED DESCRIPTION OF THE INVENTION

Preparative routes for synthesizing the precursor polyalkenylthiophosphonic acids are well known; for instance, in aforementioned U.S. Pat. No. 3,281,359 (Oberender et al.), alkenyl polymers (e.g., polyethylene, polypropylene, polyisopropylene, polyisobutylene, polybutene, or copolymers comprising such alkenyl repeat unit moieties) are reacted with $P_2S_5$. The $P_2S_5$ is present in the reaction mass at about 5–40 wt % (based upon total weight of the reactants). The reaction is carried out at temperatures of from about 100°–320° C. in the presence of from about 0.1–5.0 wt % elemental sulfur. The reaction may be continued for about 1–10 hours and a mineral lubricating oil may be added to ensure liquidification of the reaction mass.

The resulting mineral oil diluted or undiluted alkenyl-$P_2S_5$ reaction product is then steam hydrolyzed at temperatures from within the range of about 100°–260° C. Usually at least one mole of steam is reacted per mole polyalkenyl-$P_2S_5$ reaction product. As reported in the '359 patent, inorganic phosphorus acids may be also formed during the hydrolysis. These may be removed via standard techniques.

The resulting polyalkenylthiophosphonic acid (PATPA) is then reacted with a Group II(a) element or compound comprising such element in the molar reactant range of PATPA:II(a) compound or element of about 1-2:2-1. This reaction can be completed in a nonpolar solvent such as xylene or toluene or in DMSO or in an aqueous medium. U.S. Pat. No. 3,135,729 discloses other specific synthetic routes for the neutralization of the PATPA precursor by Group II(a) elements.

At present, the precursor PATPA which is preferred for use in preparing the Group II(a) PATPA salts is polyisobutenylthiophosphonic acid wherein the isobutenyl moiety of the acid has a molecular weight of about 1300. This particular acid may be prepared in accordance with the above-disclosed techniques or is available commercially. One such available commercial product is sold as a 40 vol % solution in mineral oil having a specific gravity of 0.92 at 60° F. and a viscosity of 63.9 CST at 210° F.

As to exemplary Group II(a) elements or compounds that may be used to form the inorganic Group II(a) salts of PATPA, there may be mentioned Ca, Mg, Ba, the chlorides, hydroxides, oxides, and carbonates of these II(a) elements, for instance, $CaCl_2$, CaO, $Ca(OH)_2$, MgO, $Mg(OH)_2$, $MgCl_2$, BaO, BaOH, etc. Presently, the calcium salts are preferred for use.

The resulting Group II(a) salts of polyalkenylthiophosphonic acid have the proposed structure

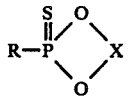

wherein X is a Group II(a) cation, such as Ca, Mg or Ba; R is the polyalkenyl moiety remaining after reaction of the alkenyl polymer with $P_2S_5$. The molecular weight of the R moiety may be within the range of about 500–10,000. R is preferably a polyisobutenyl residue, but polyethylene, polypropylene, polybutylene and polyamylene may also be used.

The antifoulant presently preferred for use has the structural formula

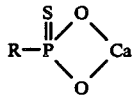

wherein R is the polyisobutenyl residue remaining after reaction of polyisobutene with $P_2S_5$ (calcium polyisobutenylthiophosphonate). The molecular weight of R is around 750–2,000.

The antifoulants are dispersed within the petroleum hydrocarbon or petrochemical within the range of about 0.5–10,000 ppm of antifoulant based upon one million parts petroleum hydrocarbon or petrochemical. Preferably, the antifoulant is added in an amount of from about 1–1,000 ppm.

EXAMPLES

The invention will now be further described with reference to a number of specific examples which are to be regarded solely as illustrative and not as restricting the scope of the invention.

In order to ascertain the antifoulant efficacy of the compounds of the present invention, apparatuses were used to pump process fluid (crude oil) from a Parr bomb through a heat exchanger containing an electrically heated rod. Then the process fluid is chilled back to room temperature in a water-cooled condenser before being remixed with the fluid in the bomb. The system is pressurized by nitrogen to minimize vaporization of the process fluid.

The apparatus used to generate the data shown in Table I contained one heated rod exchanger as described above and is referred to as the single fouling apparatus (SFA).

In the SFA tests, the temperature of the process fluid (oil outlet) was maintained at 515° F. As fouling on the rod occurs, less heat is transferred to the process fluid which is sensed by a temperature controller. More power is then supplied to the rod increasing the rod temperature so as to maintain the temperature of the oil outlet constant. The degree of fouling is therefore commensurate with the increase in rod temperature (ΔT). Accordingly, antifoulants are said to provide antifouling protection based on the percent reduction on the rod ΔT when compared to a control test (no antifoulant) in accordance with the following equation:

$$[\Delta T(\text{control} - \Delta T(\text{treatment})]/\Delta T(\text{control}) * 100 = \%\ \text{Protection}$$

The Dual Fouling Apparatus (DFA) used to generate the test data shown in Table II is very similar to the SFA in design/operation and contains two heated rod exchangers (sides 1 and 2) that are independent except for a common pump drive transmission. In the DFA tests the rod temperature was controlled at 800° F. As fouling on the rod occurs, less heat is transferred to the fluid so that the process fluid outlet temperature decreases. Antifoulant protection can be determined using the above equation and the ΔT's of the oil outlets from control and treated runs.

Additionally, antifoulant protection in the DFA tests was determined by comparing the summed areas under the fouling curves of the oil outlet temperaures for control, treated and ideal (nonfouling) runs. In this method, the temperatures of the oil inlet and outlet and rod temperatures at the oil inlet (cold end) and outlet (hot end) are used to calculate Urig coefficients of heat transfer every 30 minutes during the tests. From these Urig coefficients, areas under the fouling curves are calculated and summed over the tests for the control and treatments. The ideal case is represented as the summed area using the highest Urig coefficients. Comparing the areas of control runs (averaged) and treated runs vs the ideal area in the following equation results in a percent protection value for antifoulants.

$$\frac{\text{Area (treatment)} - \text{Area (control)}}{\text{Area (ideal)} - \text{Area (control)}} * 100 = \%\ \text{Protection}$$

The ideal areas for each side shown in Table 2 differed because the cold end rod temperature on side 2 was measured closer to the hot end of the rod than it was on side 1. This higher cold end rod temperature resulted in lower Urig coefficients and areas for side 2.

The polyisobutenylthiophosphonic acid (PIBTPA) used for the tests was purchased and was reputedly prepared similar to the procedure outlined in U.S. Pat. No. 3,281,359. As expressed therein, the polyalkenyl/$P_2S_5$ reaction product may be prepared by reacting alkenyl polymers such as polyethylene, polypropylene, polyisobutylene, polybutene or copolymers comprising such alkenyl repeat unit moieties with $P_2S_5$ (at about 5–40 wt % of the reaction mass) at a temperature of from about 100° to 320° C. in the presence of between 0.1 and 5.0 wt % sulfur. The resulting reaction mixture is then diluted with mineral oil and is then steam hydrolyzed. The polyisobutenyl moiety used to prepare the PIBTPA used in preparing Examples 1–3 has been reported as having an average molecular weight of about 1300.

EXAMPLE ONE

Preparation of Calcium Chloride Reaction Product With PIBTPA 30 grams of PIBTPA (0.01 mole) and 22.2 grams of a 10 wt % calcium chloride solution in $H_2O$ (0.02 mole calcium chloride) were mixed together over low heat for 14.5 hours. When 700 ppm of this reaction product essentially free of water was added to a Gulf Coast refinery crude oil and tested on the SFA at 515° F. oil outlet for 5.5 hours, the fouling of the crude oil was reduced 98% vs. the control as shown in Table 1.

EXAMPLE 2

Preparation of Calcium Oxide Reaction Product with PIBTA 30 grams of PIBTPA (0.01 mole) and 0.56 grams of calcium oxide (0.01 mole) were mixed together over low heat for 14 hours. When 700 ppm of this reaction product was tested on the SFA, the fouling was reduced 86% vs the control (Table 1). When 700 ppm of Example 2 was tested in a Midwest refinery crude oil at 800° F. rod temperature in the DFA for 5.0 hours, the fouling was reduced 54°–59% as shown in Table 2.

EXAMPLE 3

Preparation of Calcium Hydroxide Reaction Product with PIBTPA 150 grams of PIBTPA (0.05 moles), 12.37 grams of a 30 wt % calcium hydroxide slurry (0.05 moles calcium hydroxide), and 89.99 grams of xylene were added to a 50 mL reaction kettle equipped with thermometer, traps, and condenser. The mixture was heated to 150° C. over 0.05 hour and maintained for two hours. Approximately 8 mL of water was collected from the trap and the temperaure gradually increased to 180° C. over the next 2.5 hours. When 789 ppm of this reaction product was tested as Examples 1 and 2 in the Gulf Coast crude oil on the SFA, it showed a 98% reduction in fouling vs the control (Table 1). When tested as Example 2 in the Midwest refinery crude oil at 789 ppm, it showed a 54–56% reduction in fouling vs the control (Table 2).

When 700 ppm of the PIBTPA was added to the Gulf Coast refinery crude oil and tested on the SFA as Examples 1–3, it was found to reduce fouling by 90% vs the control. When 700 ppm of the PIBTPA was added to the Midwest refinery crude oil and tested as Examples 2 and 3 on the DFA, it was found to reduce fouling an average of 38–47%. Although the PIBTPA appears to reduce fouling comparably to the calcium reaction products prepared in Examples 1–3, it is not desirable to use acidic compounds as process stream antifoulants. Acidic components present in the process stream or generated at elevated temperature processing may likely contribute to corrosion of the processing equipment.

TABLE I

Process Antifoulants - Single Fouling Apparatus Data
Gulf Coast Refinery Crude Oil
515° F. Oil Outlet Temperature - 5.5 Hours

| | Additive (Dosage, ppm) | | # of Runs | ΔT | % Protection |
|---|---|---|---|---|---|
| | Blank | | 4 | 147.5 (Avg.) | 0 |
| Ex. 1 | $CaCl_2$—PIBTA | (700) | 1 | 2 | 98 |
| Ex. 2 | CaO—PIBTA | (700) | 1 | 20 | 86 |
| Ex. 3 | $Ca(OH)_2$—PIBTA | (789) | 1 | 3 | 98 |
| Comp. 1 | PIBTA | (700) | 1 | 14 | 90 |

PIBTA = Polyisobutenylthiophosphonic acid
MW isobutenyl moiety ≈ 1300

TABLE II

Process Antifoulants - Dual Fouling Apparatus Data
Midwest Refinery Crude Oil
800° F. Rod Set Point - 5.0 Hours

| Additive (ppm) | | Side | Runs | ΔT (Avg) | % Protection | | Area (Avg) | % Protection | |
|---|---|---|---|---|---|---|---|---|---|
| Blank | | 1 | 4 | 81 | 0 | | 208.9 | 0 | |
| Blank | | 2 | 6 | 78 | 0 | | 180.0 | 0 | |
| Ex. 2 | (700) | 2 | 1 | 36 | 54 | | 207.6 | 59 | |
| Ex. 3 | (700) | 2 | 1 | 34 | 56 | | 205.4 | 54 | |
| PIBTPA | (700) | 1 | 1 | 59 | 27 | 38 Avg | 224.1 | 24 | 47 Avg |
| | | 2 | 1 | 40 | 49 | | 213.1 | 70 | |

The antifoulants of the invention may be used in any system wherein a petrochemical or hydrocarbon is processed at elevated temperatures, and wherein it is desired to minimize the accumulation of unwanted matter on heat transfer surfaces. For instance, the antifoulants may be used in fluid catalytic cracker unit slurry systems wherein it is common to employ significant amounts of inorganic catalyst in the hydrocarbon containing process stream.

In accordance with the patent statutes, the best mode of practicing the invention has been set forth. However, it will be apparent to those skilled in the art that many other modifications can be made without departing from the invention herein disclosed and described, the scope of the invention being limited only by the scope of the attached claims.

I claim:

1. A method for controlling the formation of fouling deposits in a hydrocarbon medium during processing thereof at elevated temperatures of from about 100° F.–1500° F., comprising dispersing within said hydrocarbon medium an antifouling amount of an antifoulant compound having the structure

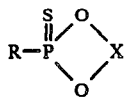

wherein R is an alkenyl moiety remaining after reaction of an alkenyl polymer with $P_2S_5$, the molecular weight of R being from about 500–10,000, and wherein X is a Group II(a) cation.

2. A method as recited in claim 1 wherein between about 0.5–10,000 ppm of said antifoulant is dispersed within said hydrocarbon medium.

3. A method as recited in claim 2 wherein between about 1–1000 ppm of said antifoulant is dispersed within said hydrocarbon medium.

4. A method as recited in claim 1 wherein said elevated temperatures are within the range of about 500° F.–1000° F.

5. A method as recited in claim 1 wherein R comprises a number selected from the group consisting of polyethylene, polyisobutylene, polypropylene, polybutylene, and polyamylene moieties.

6. A method as recited in claim 5 wherein R comprises polyisobutylene moiety.

7. A method as recited in claim 6 wherein the molecular weight of said polyisobutylene moiety is about 1300.

8. A method as recited in claim 1 wherein X is a member of the group consisting of Ca, Mg, and ba.

9. A method as recited in claim 8 wherein X is Ca.

10. A method of controlling the formation of fouling deposits in a hydrocarbon medium during processing thereof at elevated temperatures of from about 100° F.–1500° F. comprising dispersing within said hydrocarbon medium from about 0.5–10,000 ppm of calcium polyisobutenylthiophosphonate.

11. A method as recited in claim 10 wherein the molecular weight of the isobutenyl moiety of said calcium polyisobutenylthiophosphonate is within the range of about 500–10,000.

* * * * *